United States Patent [19]

Ehretsmann et al.

[11] 4,286,604

[45] Sep. 1, 1981

[54] SMOKING MATERIALS

[75] Inventors: Jacques Ehretsmann, Conches; Robert D. Cowling; Alfred D. Schweizer, both of Geneva, all of Switzerland; William M. Caldwell, Newtownards, Northern Ireland; Dennis F. Boyd, Belfast, Northern Ireland; Robert J. Boyd, Craigavad, Northern Ireland

[73] Assignee: Gallaher Limited, Belfast, Northern Ireland

[21] Appl. No.: 838,712

[22] Filed: Oct. 3, 1977

[30] Foreign Application Priority Data

Oct. 5, 1976 [GB] United Kingdom ..... 41271/76
Oct. 5, 1976 [GB] United Kingdom ..... 41272/76
Oct. 5, 1976 [GB] United Kingdom ..... 41273/76

[51] Int. Cl.[3] ..... A24B 15/18; A24D 1/18

[52] U.S. Cl. ..... 131/359

[58] Field of Search ..... 131/2, 17 R, 140 C, 131/140 R

[56] References Cited

U.S. PATENT DOCUMENTS

| | | | |
|---|---|---|---|
| 3,524,602 | 9/1970 | Hind et al. | 131/140 C |
| 3,638,660 | 2/1972 | Davis | 131/17 R |
| 3,861,402 | 1/1975 | Briskin | 131/2 |
| 3,943,941 | 3/1976 | Boyd et al. | 131/2 |

*Primary Examiner*—V. Millin
*Attorney, Agent, or Firm*—Murray and Whisenhunt

[57] ABSTRACT

The invention is concerned with a tobacco substitute which is made by subjecting a strand of viscose fibres to a controlled pyrolysis until the organic residue contains at least 90% carbon by weight, and loading the carbon strand with ingredients for smoking.

28 Claims, 1 Drawing Figure

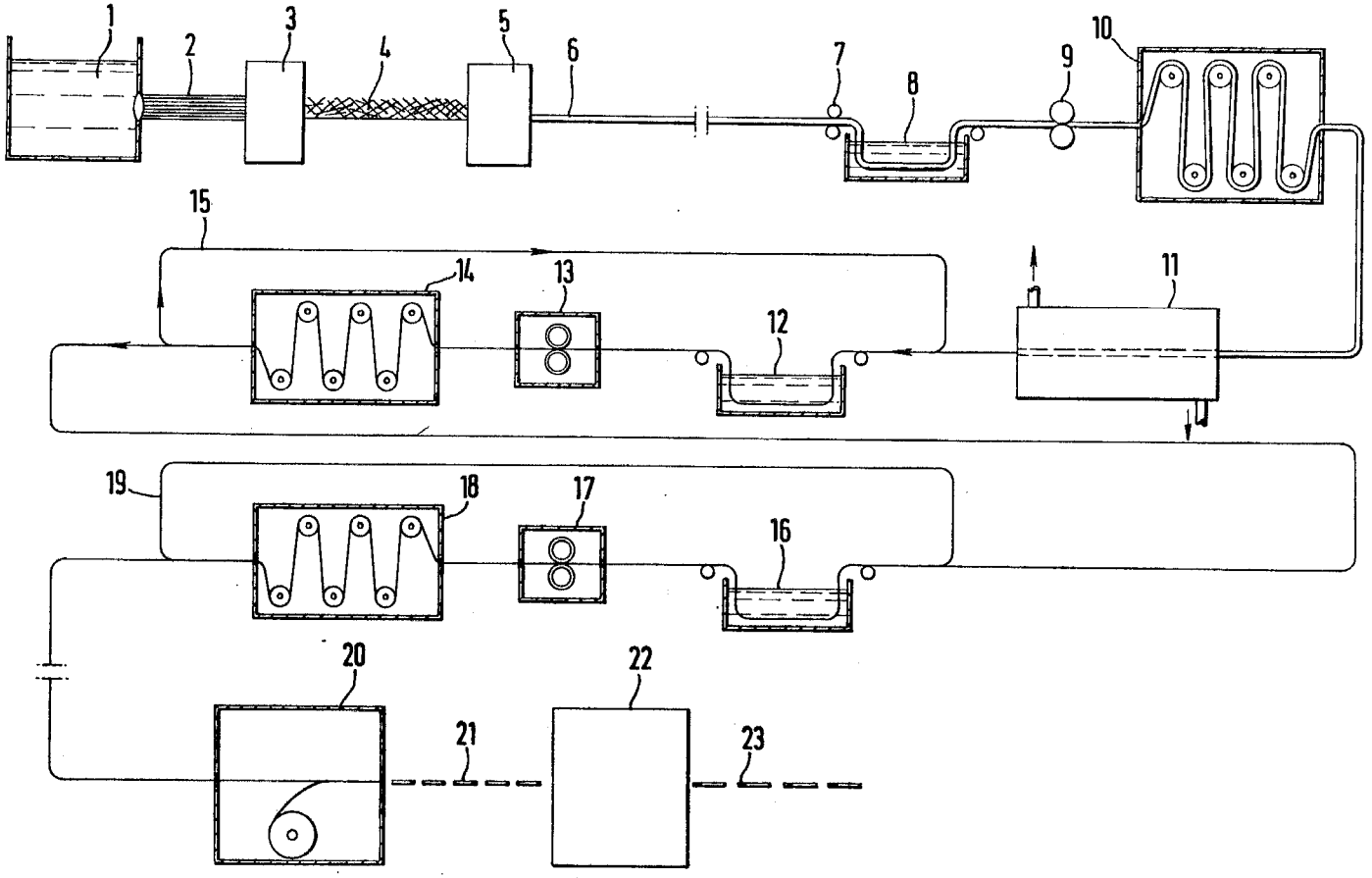
1
2
3
4
5
6
7
8
9
10
11
12
13
14
15
16
17
18
19
20
21
22
23

SMOKING MATERIALS

The invention relates to the production of a smoking product for use as a tobacco substitute.

One previous approach has involved the pyrolysis of a cellulosic material to form a basic fuel to which smoking ingredients are added. For example in U.S. Pat. No. 3,545,448 and British Patent Specification No. 1,113,979, it is proposed to subject a cellulose paper to thermal degradation at a temperature of 250° C. This results in a weight loss of no more than 40% and the degradation of cellulose to carbon is too low for any significant decrease in the potentially harmful organic components in the smoke when the product is burnt, compared with natural tobacco. Furthermore, the thermally degraded product is combined with a number of additives which themselves may contribute undesirably to the organic vapour phase of the smoke. The physical acceptability of the product is also poor for use as a cigarette filler both in terms of handling the product and the pressure drop and hardness of cigarettes filled with the product.

Another proposal is to be found in U.S. Pat. No. 3,738,374 in which a tobacco substitute is made from carbon or graphite fibres. However, commercially available graphite fibres are useless for simple combustion in air and an oxidising agent has to be incorporated, this inevitably introducing other elements and unknown health hazards.

A further proposal is to be found in U.S. Pat. No. 3,861,401 in which filaments of cellulosic material are pyrolysed at a temperature of up to 375° C., producing a weight loss of up to 70%. The carbon content of this product is also too low to be acceptable in our view and there is no appreciation of the importance of the physical parameters of the cellulose filaments which are thermally degraded.

In our British Patent Specification No. 1,431,045 we disclose a tobacco substitute consisting essentially of a carbonaceous fuel which, disregarding any inert fillers, consists of at least 80%, and preferably over 90%, carbon by weight, and includes no elements other than carbon hydrogen and oxygen. The fuel is prepared by the controlled pyrolysis of a cellulosic material. The raw material from which the fuel is produced, and hence the fuel, preferably consists of a coherent mass of fibres which has, after the pyrolysis, a cross sectional dimension of between 1 and 50$\mu$. Upon pyrolysis the cellulosic material is degraded with the result that when the fuel is burnt, the combustion products are essentially carbon dioxide and water which involve no health risks when inhaled. When used as a tobacco substitute, the fuel is associated as necessary with agents, such as flavouring agents, smoke producing agents, and combustion modifying (which term includes ash producing) agents.

In our published German Patent Application No. 2,416,876, reconstituted cellulose in the form of viscose is disclosed as the precursor for the fuel.

Our subsequent experiments have shown that viscose is an exceptionally good starting material owing to the possibility of obtaining large quantities of viscose in fibrous form with selected and uniform dimensions and composition which are virtually impossible with any naturally occuring cellulosic fibrous material. The use of viscose therefore enables a smoking product to be mass produced with exactly the properties which experiments show to be most desirable. Apart from its reliable reproducibility, fibrous viscose has the advantage that it has a high bending modulus, both before and after pyrolysis, which simplifies handling of the product.

It has been disclosed in British Patent Specification No. 1,269,057 to load a sliver of regenerated cellulose fibres with tobacco flavouring substances and wrapping the sliver to form a cigarette. However, no thermal degradation of the cellulose takes place.

During the pyrolysis of the fibrous cellulosic material as disclosed in our aforementioned Patent Specifications Nos. 1,431,045 and 2,416,876, the material suffers a weight loss of 80% or more and the physical structure of the fuel, although still consisting of coherent fibres with a degree of flexibility, is less resistant to handling than the starting material, and is generally inferior in this respect to shredded natural tobacco. As a result difficulties may arise when making up the fuel into, for example, continuous cigarette rod form using conventional tobacco handling machinery, and excessive handling of the material is undesirable if fracture and dusting of the fuel fibres with consequent wastage is to be avoided.

In accordance with the present invention, in a method of making a continuous cigarette rod, a strand of viscose fibres is subjected to controlled pyrolysis until the organic residue contains at least 90% carbon by weight, and the resulting strand is loaded with the ingredients for smoking.

The strand form of the viscose makes it extremely convenient for handling during the pyrolysis and other treatment steps. A number of strands may be bulked up or laid along side one another to form a mat during the pyrolysis step, and the strand may be subsequently chopped, for example for use in the production of a substitute tobacco for pipe smoking or for blending. Preferably, however, the strand has a cross section such that the final strand product is ready for wrapping directly, as the strand is passed longitudinally through a wrapping station, with a tubular wrapper to form a continuous cigarette rod. This involves the minimum of intermediate handling and after the wrapping, the rod can be cut into individual cigarette rod lengths to be manipulated, for example, for application of filter tips, and packaging, in the manner of conventional cigarettes.

By a strand is meant a continuous longitudinal bundle of fibres, although they may be twisted into groups or may be plaited before or after pyrolysis to increase the linear strength of the strand and uniformity of linear density. The fibres may be substantially continuous so that the strand is in the form of a tow, but more usually they will be staple fibres so that the strand is in the form of a sliver. The staple fibres then preferably have a length of between 20 and 100 mm. These limits are determined by the use of the product as a cigarette filler taking into account that the fibres are subjected to a reduction in length of about 30% during the pyrolysis, and the avoidance of filler fallout at the end of a cigarette which conventionally has a length of about 56 mm.

The denier of the fibres is also important. Extensive tests covering the range of fibres between 1.3 and 50 denier have shown that high denier fibres are unsuitable because the carbons produced by their pyrolysis are too brittle, and very low denier fibres are unsuitable because the carbon produced by their pyrolysis gives an unacceptable high draw resistance. The preferred range is between 5 and 20 denier.

The fibres are preferably crimped thereby giving the strand an increased filling capacity. That is to say in the eventual cigarette product an acceptable hardness and pressure drop with the use of less material per cigarette than in the absence of crimping. Although a high crimp is desirable, crimping in excess of 8 crimps, that is complete waves, per cm. are unsuitable because they are limited to low denier fibres which are unsuitable because of their high draw resistence in the cigarette. Consequently between 6 and 8 crimps per cm. are preferred.

Viscose fibres come in round and rectangular cross sections but tests have shown that rectangular fibres cannot be crimped to the desired degree and consequently fibres of substantially round section are preferred.

With these parameters in mind, the cross section of a suitable strand will have between 2000 and 72000 fibres and the strand, after pyrolysis, will have a linear density of organic residue of between 1.5 and 7 g. per m. After the pyrolysis the fibres will have a mean cross sectional dimension, that is a mean diameter, which is preferably between 5 and 50μ, or between 5 and 35μ when the fibres are crimped.

The viscose strand may be pyrolysed in an oven in batches but this is inefficient both as regards energy and time. Preferably therefore the viscose strand is passed continuously or in steps through the oven. The viscose strand may be transported through the oven in reels or loosely coiled in baskets but this may involve difficulties in ensuring homogeneous pyrolysis of the viscose. Preferably therefore the strands are transported continuously through the oven. They must pass through the oven in such a way that uniform and acceptable heat and mass transfer conditions can be maintained in order to control the quality of the carbonaceous strand produced. This can be achieved, for example by any form of regular geometric layout of the continuous strand onto the specifically designed transport system. This layout must allow a maximum free access of heat and of the pyrolysis atmosphere, over the full length of the strand under thermal treatment. Possible geometric arrangements for the layout of an individual strand are coiling, zig-zagging, or straight longitudinal advance. More than one strand may be transported in parallel in one or more heated tubes or ducts. Whether the strand is a tow or a sliver, its tensile strength will usually be such that it is impossible to draw the strand through the oven and intermediate transport means, such as complementary driven rollers, or a transporting band of other conveyor is necessary.

In the oven the viscose strands will be subjected to a particular temperature time profile. Various stages in the reaction may be identified though these may not necessarily be physically segregated. The temperature time profile is important in producing a strand with satisfactory properties.

On initial heating the viscose is dried while it is raised from room temperature to between 200° C. and 300° C. The second stage from between 200° C. and 300° C. to between 400° C. and 550° C. involves the major chemical transformation reactions of the viscose. This stage has an important influence on the subsequent properties of the carbonaceous strand in that too fast a rate of heating results in a poor product with a low yield, excessive fragility, and low bulk, making the product unsuitable for processing into cigarettes. On the other hand, a very slow heating rate, whilst possibly giving an excellent carbonaceous product, will be uneconomic in terms of throughput. Up to 80% or more by weight of the viscose content of the fibre will be driven off as volatile degradation products during this second stage and the strand is subjected not only to a reduction in cross section but also an appreciable longitudinal shrinkage of up to 30%. This shrinkage must be allowed for in any transport means for the strand through the oven.

Thereafter the temperature of the strand can be quickly raised to between 700° and 1200° C., preferably between 800° C. and 1000° C., and maintained for long enough to complete the transformation of the viscose to carbon. In this stage any final volatile degradation products are driven off.

This stepwise heating of the viscose may be such that in the second stage the temperature is raised from between 200° C. and 300° C. to between 400° C. and 550° C., over a period of about 3 minutes, after which the partly pyrolysed product is quickly raised to the final pyrolysis temperature and maintained there for a period of about 2½ minutes. In practice it is expected that this may best be achieved by passing the strand on a stainless steel band longitudinally through a tube furnace having a temperature profile along its length.

During the pyrolysis the strand must be kept under an inert atmosphere, such as nitrogen, steam, or a mixture of nitrogen and steam, together with some recycled gaseous products of the pyrolysis if necessary after having passed through a clean up system.

During the pyrolysis, the viscose will be degraded and the resulting fibrous carbonaceous fuel, in terms of organic residue excluding any additives, will include at least 90% carbon by weight. It is believed that ideally the carbon content should be between 95% and 98% by weight, the oxygen content between 1 and 4% by weight, and the hydrogen content less than 1% by weight. Due to these oxygen and hydrogen concentrations the organic vapour phase contributed by the carbonaceous strand in a conventional shaped cigarette is less than 0.1% of the organic vapour phase of a standard tobacco filler smoked under the same conditions. These contents of oxygen and hydrogen are important in determining the combustibility of the fuel. As the oxygen and hydrogen contents decrease below these limits by increasing the final pyrolysis temperature, the fuel no longer sustains its combustion in cigarette form. In practice it is found that for self-sustaining combustion the fuel must show an ignition temperature of less than 800° C., and preferably between 450° and 560° C.

The viscose fibres will be, prior to pyrolysis, flexible and strong and resistent to handling. It is desirable therefore to add to the viscose fibres, prior to pyrolysis, any of the fillers or additives which are necessary in the conversion of the viscose into a tobacco substitute, and which will not be lost or degraded during the pyrolysis. Generally speaking formulating agents in the form of nicotine, flavouring agents, and smoke producing agents, will be volatile and cannot be added prior to the pyrolysis. However, carriers for the volatile agents, catalysts for the pyrolysis, and combustion modifying agents or their precursors, which are not lost during the pyrolysis, are preferably added prior to the pyrolysis. Additives to the viscose prior to pyrolysis will be included in a proportion to the organic viscose which is about one sixth of the proportion required to remain in the organic residue after pyrolysis, to allow for the weight loss during pyrolysis of the viscose. Some of these may be introduced as fillers into the bulk viscose mix prior to spinning in which case they will be homogeneously distributed throughout the viscose fibres. Such fillers should have a particle size of less than 2μ to enable their complete dispersion in the mix. Other additives, particularly those which would be undesirably effected by the spinning bath or the subsequent washing steps, particularly in acid, may be homogeneously dispersed in the viscose strand, for example by spraying on to staple fibres from which a sliver is made, by application to the strand with a binder, or by passing the strand through a dip. Such dipping may be carried out immediately after the spinning so that only a single drying step is necessary.

During the pyrolysis, the viscose suffers a weight loss of 80% or more and it is important to optimize the yield of carbonaceous material from the viscose. The introduction of active carbon, preferably in an amount of between 1.5% and 12.5% of the organic content of the viscose, into the bulk viscose mix prior to spinning of the viscose fibres, is found to have a beneficial effect on the yield in the subsequent pyrolysis. By introducing the active carbon into the bulk viscose mix, the active carbon becomes homogeneously dispersed throughout the viscose fibres so as to have a substantially homogeneous effect during the pyrolysis. In experiments which have been carried out, the introduction of 1.75%, 3.6%, 7.35% and 12.1% active carbon by weight resulted in a carbon yield of 17.4%, 17.8%, 21.3% and 20.9%, respectively, representing a yield increase of 7.4%, 9.9%, 31.4% and 29%. respectively over a control yield of 16.2% carbon.

When the fibrous carbonaceous strand is made up into cigarettes with a conventional wrapper and conventional geometry, it is found that the combustion and ashing properties are different from those of natural tobacco cigarettes as regard length consumption with time, burning cone length, ashing properties, and ash appearance. The completeness of the combustion is also generally insufficient, so that the smoking residue contains the general structure of the strand, and is still relatively strong and coherent. The smoking residue cannot be tapped off the same way as that of the natural tobacco cigarette.

We now find that these problems can be mitigated by incorporating in the fibrous carbonaceous material certain inorganic combustion modifying agents which do not themselves contribute directly to the combustion. The combustion modifying agents may be incorporated in the fibrous material either before or after the pyrolysis of the viscose. If it is incorporated before the pyrolysis it must be a material which is unaffected at the pyrolysis temperature of up to 1000° C., or it must be the product of heating a precursor at the pyrolysis temperature.

When incorporated prior to the pyrolysis, the combustion modifying agent or its precursor may be applied to the viscose in three possible ways. First it may be applied using a binder. Secondly it may be added to the bulk viscose mix prior to spinning of the viscose fibres so as to form a filler homogeneously dispersed in the viscose. This is possible if the combustion modifying agent is a water insoluble and acid insoluble material which is unaffected by the spinning bath and subsequent washing steps. Examples of such agents are carbon black; oxides or insert salts of aluminum, or titanium, or an alumino silicate such as Bentonite, Fuller's Earth, or Kaolin, or silica such as Gasil. These agents may be incorporated in the viscose in an amount of up to 10% by weight. An amount of up to 1.5% by weight of titanium dioxide is preferred as tests have shown that this leads to a significant improvement in the burning properties of the resulting cigarette product, compared to the use of "bright" viscose.

Thirdly, if the combustion modifying agent or its precursor, is a water soluble compound, it may be applied to the viscose strand by contacting the fibres with a solution of the agent or its precursor and subsequently deliquoring and drying the fibres. The contacting may be carried out immediately after spinning the fibres without an intermediate drying step. Alternatively the strand may be dipped in an aqueous solution of the compound. The combustion properties of the carbon in the resulting cigarette product are improved by the incorporation of certain metals known to act as carbon combustion catalysts. The oxides or inert salts of these metals, particularly sodium, potassium, silver, copper, calcium, and magnesium, or their precursors, can be applied in solution at this prepyrolysis stage. Thus treatment of the viscose with a solution of copper or calcium nitrate leads to the incorporation of the corresponding oxides in the carbon after pyrolysis. In a preferred treatment, however, the viscose is contacted with a solution of calcium formate, which decomposes to the carbonate during the pyrolysis of the viscose, resulting in improved burning properties of the carbon. The calcium formate is preferably applied in aqueous solution at a concentration of between 0.04 and 0.07 molar which, after 50% deliquoring of the fibres, results in a deposit of between 0.15 and 0.27% calcium by weight of the viscose and between 1.0 and 1.7% calcium by weight of the organic carbon residue after pyrolysis.

After the pyrolysis, the carbonaceous strand is preferably treated with a further combustion modifying agent in the form of an inorganic salt solution which is dispersed in the pyrolysed strand by contacting the strand with a solution of the agent. This may be achieved by dipping the pyrolysed strand in a solution of the agent and subsequently deliquoring and drying the strand. The principle function of this agent is to increase the otherwise low puff number of the cigarette and to improve the characteristics of the cigarette ash. Suitable glow retarding agents applied in this manner include any one or more of ammonium dihydrogen phosphate; diammonium hydrogen phosphate; the mono-, di-, and tri-phosphates of sodium or potassium; and the meta- and tetra-borates of sodium, potassium, or calcium. A solution which gives a particularly successful result in terms of puff number and ashing behaviour when the fibres have been treated prior to pyrolysis with calcium formate as described, is a mixture of tripotassium phosphate, trisodium phosphate, and potassium dihydrogen phosphate, in concentrations sufficient to provide between 10 and 80 gram of retained salts (discounting any water subsequently absorbed owing to the hygroscopic nature of tripotassium phosphate) per 100 grams of carbonaceous organic residue. After deliquoring and drying, the carbonaceous organic residue may contain as much as its own weight in added inorganic material including the titanium dioxide, calcium carbonate, phosphates, and water.

One important ingredient which it is desirable to apply to the pyrolysed viscose strand to produce a substitute tobacco is nicotine. The nicotine must be held to the fuel so that it is not lost by premature volatilization during storage but is transferred to the smoke stream at a satisfactory rate during combustion of the fuel. If the nicotine component is unstable, the carbonaceous fuel is not itself a good carrier for the nicotine and there must be incorporated in the fuel a suitable carrier which stabilizes nicotine against oxidation or volatalization, and is itself inert at the combustion temperature of the fuel and does not make any significant contribution to the smoke stream. Ideally, the carrier for the nicotine component is homogeneously dispersed in the viscose strand prior to the pyrolysis step. It may then be homogeneously dispersed within viscose fibres by being introduced into the bulk viscose mix prior to spinning of the viscose fibres. Such suitable carriers for the nicotine component consist of an alumino silicate, such as Bentonite, Kaolin, or Fuller's Earth; aluminum oxide; or silica, such as Gasil. Of these Gasil is preferred. After the pyrolysis, the nicotine component will be applied to the fuel and will be adsorbed by the carrier where it will be held until the fuel is subsequently burnt, at which time the nicotine will be transferred into the smoke stream.

The amount of carrier required depends upon the amount of nicotine required to be adsorbed which is between 1.0 and 20 mg. and preferably about 7.5 mg. per standard cigarette, that is per 56 mm. length of pyrolysed strand. 10% of this is likely to be transferred into the smoke to give a nicotine level in the smoke of, in the preferred case, 0.75 mg. per cigarette. Assuming a 40% absorption of the nicotine by the carrier, this means that the carrier must be dispersed at a level of between 2.5 mg. and 50 mg. per cigarette length of strand, corresponding to between 0.1% and 2.8% by weight of carrier in the viscose and between 0.83% and 16.7% by weight in the organic residue after pyrolysis.

Alternatively, and in some ways preferably, when the nicotine component is a stable nicotine salt it may be homogeneously dispersed in the strand in aqueous solution, for example by dipping the strand in a bath of the solution and subsequently deliquoring and drying the strand, in a similar manner to that in which the combustion modifying agents are added in solution after pyrolysis. Acceptable stable nicotine salts for adding in this manner include nicotine ascorbate, nicotine citrate, nicotine lactate, nicotine succinate, and nicotine hydrogen tartrate, of which the latter is preferred. Assuming a 50% retention of the salt after deliquoring, the nicotine hydrogen tartrate is preferably applied in a solution of between 0.33 and 6.7% by weight to provide the same level of nicotine addition as referred to above.

Smoke producing agents are preferably added to the pyrolysed carbonaceous fuel strand because the predominant combustion products of the carbonaceous fuel are carbon dioxide and water, which are colourless gases and vapours and it is necessary to give the smoker the visual satisfaction of both side stream and main stream smokes. The latter should have the capability of producing an exhaled smoke as occurs when smoking natural tobacco. The requirements of a smoke producing agent are that it distils without decomposition upon proximity to the burning part of the fuel and is entrained in the gas stream drawn by the smoker through the cigarette, condensing in the cooler gas stream and forming a stable suspension of minute droplets or particles. Smoke producing agents in the form of natural oils or alcohols have been proposed but these are not entirely satisfactory, either because of their inefficient distillation into the gas stream, requiring a large quantity of the smoke producing agents to be used, or, in the case of alcohols, because their high hygroscopicity and prevalence to hydrogen bonding which has caused them to be retained in undesirably high quantities in the lungs, thus producing no exhaled smoke.

We prefer to use a smoke producing agent consisting of a non-toxic aliphatic ester of a mono-, di- or poly-carboxylic acid, the ester having a boiling point between 200° C. and 450° C. and containing no elements other than carbon, hydrogen, oxygen, and possibly a non-toxic metal such as sodium, potassium, calcium, magnesium or strontium. To avoid staining of the subsequent wrapper, the ester is preferably a solid, having a melting point greater than 40° C.

Such esters are found to act as good smoke producing agents. The volatility of the esters, having a boiling point between 200° C. and 450° C. is not so high that the majority of the smoke producing agent distils off and is lost to side stream smoke but is such that sufficient remains to produce a adequate main stream smoke. On the other hand the volatility of the esters is not so low that appreciable cracking of the esters occurs before distilling into the main stream smoke.

The selected esters also have the advantage that they will form stable aerosols with a mean particle size in the order of 0.5$\mu$. The comparatively inert and non-hygroscopic nature of esters, enables the smoke which they produce to be inhaled and exhaled by the smoker with the minimum of retention in the lungs. The carboxylic acids from which the esters are formed may be mono-, di-, or poly-carboxylic straight chain carbon oxy- or hydroxy- acid, and there may be advantages if the acid is unsaturated.

The alcohols from which the esters are formed may be mono-, di-, or tri-hydric alcohols including those which contain an oxygen atom in the carbon chain e.g. diethylene glycol. There are also believed to be advantages if the alcohol is unsaturated. In particular the alcohols preferred are those in which the carbon atom $\beta$ to the hydroxyl group is not bonded to any hydrogen atoms. When such alcohols are used to prepare esters the latter are $\beta$ -blocked esters e.g. neopentyl esters. This configuration results in esters exhibiting increased thermal stability. Methyl esters are also preferred since as they do not contain any $\beta$ carbon atom they also exhibit good thermal stability.

Examples of suitable esters are methyl palmitate, methyl stearate, vinyl stearate, dimethyl sebacate, dimethyl dodecandioate, dimethyl tetradecandioate, dimethyl hexadecandioate, glyceryl trimyristate, pentaerythrityl tetracetate, monoethyl sebacate, trimethyl citrate, myristyl myristate, palmityl palmitate, glyceryl monostearate, glyceryl trilaurate, and vinyl oleate.

These smoke producing agents may be dispersed in the strand by dipping the pyrolysed strand in a solution of the agent and subsequently deliquoring the drying the strand as in the previously discussed application of stable nicotine components and combustion modifying agents in solution. Simple solvents, such as water, ethyl alcohol, methyl alcohol, dichloromethane, hexane, ether, and acetone may be used as solvents and ethyl alcohol is preferred. With approximately a 100% solution retention by weight of organic residue after deliquoring, the concentration of the contacting solution may be readily arranged to provide an addition of ester in the range 5 to 15% by weight of organic residue, which is acceptable.

Proprietory flavouring agents are preferably also applied to the strand to complete the formulation of the smoking product. These flavouring agents may be added in a similar manner to the smoke producing agents.

When additives are to be dispersed in the strand it is preferred to impregnate the strand with the additives in solution, rather than to attempt to spray on the additives or to apply them as an emulsion. The solvents used must of course be non-toxic and acceptable in the context of a smoking material, particularly in case of residue after treatment. The impregnation is preferably carried out by dipping, by passing the strand longitudinally through a bath of the solvent. Ideally the strand is passed through a nip immediately before entering the bath, so that it absorbs the solution throughout its cross section upon relaxing in the bath, and is then passed through a further nip on leaving the bath to expel the excess liquor. It may then be subjected to hot air drying, for example at a temperature of between 100° and 110° C. when the solvent is water, or between 55° and 65° C. when the solvent is alcohol. This will leave the additive homogeneously dispersed throughout the strand. This procedure is satisfactory prior to the pyrolysis as the strand is flexible, resilient, and resistent to handling. However, after pyrolysis, the strand is more brittle and liable to dusting and great care must be taken in passing the strand through a nip. For this reason in the impregnation stages after pyrolysis, it may not be possible to pass the strand through a nip prior to dipping and after dipping it may be necessary to deliquor the strand by passing it through specially formed vacuum rolls. Such vacuum rolls may comprise a pair of rollers, the peripheral surface of each roller being provided by a soft cushion of porous material, and a suction being applied radially inwardly through the cushion of at least one of the rollers adjacent to the nip.

The peripheral cushions on the roller will be made of a material such as open celled natural or synthetic elastomeric foam, which deforms to accommodate the strand so that the strand is gently gripped but not so flattened as it passes through the nip that the strand is significantly damaged. The application of suction through one or both of the rollers enables an appreciable proportion of the excess liquor in the strand to be drawn out and deposited in a liquor trap, leaving the strand sufficient solution to provide, upon subsequent evaporation of the solvent, the necessary quantity of additive dispersed in the strand.

When hot air is subsequently passed through the strand for drying, it is possible to inject hot air into the strand through the cushion of at least one of the same or a different pair of the cushioned nip rollers. Thus for example, when a single pair of cushioned nip rollers are used, suction may be applied through the adjacent part of the cushion of one or both rollers upstream of the centre point of the nip, and hot air may be applied through the adjacent part of at least one of the cushions downstream of the centre point of the nip. When hot air is applied in this way, it is preferably opposed by suction applied through the complementary part of the other rollers, so that the air is drawn right through the strand. However, it would be possible to apply the hot air without any opposed suction, or even hot air through opposed cushioned parts of both rollers.

The cushioned nip rollers are preferably driven, usually to provide traction on the strand, but at least to maintain the same linear contact speed with the strand.

Each roller through the cushion of which suction is drawn or hot air is forced, preferably consists of a perforated cylindrical shell to the outer surface of which the annular porous cushion is secured. The shell rotates around a fixed manifold which is open to the interior of the perforated shell adjacent to the nip with the other roller. The manifold is connected by appropriate ducting axially through an end of the sleeve for coupling to an appropriate source of suction or hot air.

The preferred manner of producing a cigarette from a smoking product manufactured in accordance with the invention will now be described with reference to the accompanying diagrammatic drawings.

A viscose mix consisting of regenerated cellulose incorporating 1.5% by weight of the cellulose of titanium dioxide and 5% by weight of the cellulose of active carbon, both the additives having a particle size of less than 2μ., were prepared in a spinning bath 1. 8 Denier fibres were spun from the mix in the bath, the fibres were given a crimp with 7 waves per cm. and formed into a tow 2. The tow was passed through a cutter 3 which cut the fibres into staple lengths 4 which were 73 mm. long. The staple fibres were then carded on a conventional carding machine 5 to produce a sliver 6 with a linear density of 18 g/m. The sliver may be stored or immediately treated further.

The sliver was passed through a pair of nip rollers 7 and through a bath 8 containing a 0.055 molar solution of calcium formate, deliquored by passing through further nip rollers 9, and dried in a hot air dryer 10. This treatment produced a resulting calcium ion content of 0.2% by weight of the weight of organic viscose in the sliver strand.

The sliver was then pryolysed by transporting it longitudinally on a stainless steel belt at 60 cm. per min. through a furnace 11 which was 5 meters long and had a temperature profile of 250° C. at its inlet end rising gradually to 420° C. at the 3 meter point, rising to 800° C. at the 4 meters point, and continuing at that temperature to the outlet end of the furnace. The pyrolysed strand contained 89.2% organic residue, 9.4% titanium dioxide, and 1.4% calcium. The organic residue represented a yield of 17% by weight of the original viscose and the organic residue had a composition of 97.9% carbon, 0.3% hydrogen and 1.8% oxygen. The pyrolysed fibres has a mean diameter of 13.5μ.

The pyrolysed strand was then passed through a bath 12 containing a 0.5 molar aqueous solution of tripotassium phosphate, a 1.0 molar aqueous solution of trisodium phosphate, a 3.5 molar aqueous solution of potassium dihydrogen phosphate and a 2.5% aqueous solution of nicotine hydrogen tartrate. After leaving the bath 12 the strand was passed through cushioned nip rollers 13 and a hot air dryer 14. This left the strand loaded with 70 g. of phosphate salts per 100 g. of carbonaceous organic residue and 7% of nicotine hydrogen tartrate by weight of carbonaceous organic residue.

Under some circumstances it might be necessary to recycle the strand around a path 15 and through the bath 12 again to leave the strand impregnated with these quantities of salts.

The strand was then passed through a second bath 16 containing a 10% by weight ethyl alcohol solution of glyceryl trimyristate, and a flavouring agent. On leaving the bath 16 the strand was passed through further cushioned nip rollers 17 and a hot air dryer 18. Again under some circumstances the strand may be recycled around a path 19 and through the bath 16 again. This treatment left the strand impregnated with 0.47 g. of the ester per m. of strand.

The resulting strand was stored in a can or on a reel from which it was subsequently fed through a garniture for wrapping with a conventional wrapper in a cigarette making machine 20 to produce a continuous cigarette rod of 25 mm. circumference, the filler formed by the strand providing a weight of 300 mg. of organic residue per cigarette length of 56 mm. of rod. The rod was then cut into standard 56 mm. lengths 21 and fitted with a 10 mm. standard filter in a tipping machine 22 to produce tipped cigarettes 23. The final composition of the cigarettes, excluding the filter, was organic residue 42.0%; phosphate 25.5%; titania 4.5%; calcium, sodium and potassium metal ions 14.5%; nicotine salt 3.5%; smoke producing ester 4.5%; flavouring agent 1.0%; and wrapper 4.5%.

The cigarette pressure drop was found to be 100 mm. of water with a hardness of 90%. On smoking under standard smoking conditions an organic vapour phase of 0.2%, and a particulate matter yield of less than 0.25% of a standard flue cured cigarette was obtained from the filler.

We claim:

1. A method of making a smoking product by subjecting a mass of viscose fibres to a controlled pyrolysis until the organic residue contains at least 90% carbon by weight, and loading the resulting fibrous mass with the ingredients for smoking, wherein at least one additive selected from the group consisting of a catalyst for the pyrolysis, a carrier for a stimulant additive, and a combustion modifying agent or its precursor is added to a bulk viscose mix and said fibres are spun from said mix whereby the additives are homogeneously dispersed throughout the individual fibres.

2. A method of making a tobacco substitute smoking product fuel, said method comprising providing a mass of substantially round cross-section, crimped viscose fibers having a denier of between 5 and 20, and a length of between 20 and 100 mm, and subjecting the mass of viscose fibers to controlled pyrolysis until the organic residue contains at least 95% carbon by weight, an oxygen content of between 1 and 4% by weight, and a hydrogen content of less than 1% by weight.

3. Method according to claim 2, wherein the fibers have between 6 and 8 crimps per cm.

4. Method according to claim 2, wherein the viscose fibers are in the form of a silver of staple fibers.

5. Method according to claim 4, wherein said sliver has, after the pyrolysis, a linear density of organic residue of between 1.5 and 7 g/m.

6. The product produced by the method of claim 5.

7. The product produced by the method of claim 2.

8. A wrapped continuous form tobacco substitute rod comprising a tobacco substitute smoking product fuel of claim 7 in continuous strand form and a wrap therefor.

9. A method of making a tobacco substitute smoking product fuel, said method comprising providing a mass of viscose fibers and subjecting said viscose fibers to controlled pyrolysis until the organic residue contains at least 90% carbon by weight by the stepwise heating of said mass by first raising the temperature of said mass gradually from between 200° C. and 300° C. to between 400° C. and 550° C. to dry said mass and provide the major chemical transformation reactions of the viscose, and thereafter quickly raising the temperature of said mass to between 700° C. and 1200° C. for long enough to complete the transformation of the viscose to carbon.

10. Method of claim 9, wherein said mass is passed in strand form longitudinally, either continuously or in stepwise manner, through a pyrolysing oven.

11. Method according to claim 9, wherein the pyrolysis step is carried out in an oven in the presence of a non-reactive atmosphere which comprises nitrogen, steam, or mixture thereof.

12. The product produced by the method of claim 9.

13. A wrapped continuous form tobacco substitute rod comprising a tobacco substitute smoking product fuel of claim 12 in continuous strand form and a wrap therefor.

14. A method of making a tobacco substitute smoking product fuel, said method comprising providing a mass of viscose fibers and subjecting said mass of viscose fibers to controlled pyrolysis in an oven in the presence of a non-reactive atmosphere which comprises nitrogen, steam, or a mixture thereof, and which also includes some recycled gaseous products of the pyrolysis, until the organic residue contains at least 90% carbon by weight.

15. A method of making a smoking product for use as a tobacco substitute, said method comprising providing a mass of viscose fibers having a nicotine component carrier homogeneously dispersed therein, thereafter subjecting the mass of viscose fibers to controlled pyrolysis until the organic residue contains at least 90% carbon by weight, and thereafter loading the pyrolysed product with the ingredients for smoking including a nicotine component.

16. Method according to claim 15, wherein said carrier for said nicotine component comprises an alumino silicate, aluminum oxide or silica.

17. A method of making a tobacco substitute smoking product fuel, said method comprising providing a bulk viscose mix, dispersing a carrier for a nicotine component within the bulk viscose mix, spinning the bulk viscose mix to produce viscose fibers having said nicotine component carrier dispersed therein, and subjecting a mass of viscose fibers to controlled pyrolysis until the organic residue contains at least 90% carbon by weight.

18. A method for making a smoking tobacco substitute product fuel, said method comprising providing a mass of viscose fibers having homogeneously dispersed therein at least one inorganic combustion modifying agent, and thereafter subjecting the viscose fibers to controlled pyrolysis until the organic residue contains at least 90% carbon by weight to produce a pyrolysed product with said inorganic combustion modifying agent homogeneously dispersed therein.

19. A method for making a smoking tobacco substitute product fuel, said method comprising providing a mass of viscose fibers having homogeneously dispersed therein at least one inorganic combustion modifying agent precursor, and subjecting the viscose fibers to controlled pyrolysis until the organic residue contains at least 90% carbon by weight and said inorganic combustion modifying agent precursor is converted into an inorganic combustion modifying agent, to produce a pyrolysed product with said inorganic combustion modifying agent homogeneously dispersed therein.

20. Method of claim 19, wherein said inorganic combustion modifying agent is calcium carbonate.

21. Method of claim 20, including the additional step of dispersing in said pyrolysed mass, a further combustion modifying agent which is at least one of ammonium dihydrogen phosphate; diammonium hydrogen phosphate; the mono-, di- and tri-phosphates of sodium and potassium; and the meta- and tetra-borates of sodium and potassium, by contacting said pyrolysed product with a solution of said further combustion modifying agent.

22. Method of claim 19, wherein said precursor is calcium formate.

23. Method of claim 19, wherein said precursor is calcium nitrate.

24. Method of claim 19, wherein said precursor is applied to said viscose fibers in the form of a solution of said precursor.

25. A method for making a smoking tobacco substitute product fuel, said method comprising providing a mass of viscose fibers, applying calcium formate to said viscose fibers in the form of a calcium formate solution, to homogeneously disperse said calcium formate into said mass, thereafter subjecting said mass to controlled pyrolysis until the organic residue contains at least 90% carbon by weight, and said calcium formate is converted to calcium carbonate, to produce a pyrolysed product with said calcium carbonate homogeneously dispersed therein, and thereafter dispersing in the pyrolysed product a further combustion modifying agent which is at least one of ammonium dihydrogen phosphate, diammonium hydrogen phosphate, the mono-, di- and tri-phosphates of sodium and potassium, and the meta- and tetra-borates of sodium and potassium, by contacting said pyrolysed product with a solution of said further combustion modifying agent.

26. Method of claim 25, wherein said calcium formate and said further combustion modifying agent are dispsered on said fibers in said mass by dipping said mass in a solution of said calcium formate, and subsequently deliquoring and drying said fibers, and by dipping said pyrolysed mass in a solution of said further combustion modifying agent, and subsequently deliquoring and drying said pyrolysed mass.

27. A tobacco substitute smoking product fuel, said fuel comprising pyrolysed viscose fibers having a carbon content of at least 90% carbon by weight of the organic pyrolysis residue, and having calcium carbonate homogeneously dispersed therein as an inorganic combustion modifying agent.

28. The fuel according to claim 27, wherein said fuel additionally contains a further combustion modifying agent which is at least one of ammonium dihydrogen phosphate; diammonium hydrogen phosphate; and mono-, di- and tri-phosphates of sodium and potassium; and the meta- and tetra-borates of sodium and potassium.

* * * * *